United States Patent [19]

Hilker

[11] 4,076,490

[45] Feb. 28, 1978

[54] FIREPLACE SYSTEM

[76] Inventor: Gloria D. Hilker, 1109 S. Landmark Trail, Hopkins, Minn. 55343

[21] Appl. No.: 746,387

[22] Filed: Dec. 1, 1976

[51] Int. Cl.[2] ..... A41G 1/00

[52] U.S. Cl. ..... 431/125; 272/8 F; 428/17; 428/18; 431/295

[58] Field of Search ..... 428/15, 17, 18; 272/8F, 272/15; 431/291, 125; 40/106.52, 106.53, 106.54, 126 R; 44/38, 41; 156/61

[56] References Cited

U.S. PATENT DOCUMENTS

| | | | |
|---|---|---|---|
| 2,084,566 | 6/1937 | Warfield | 431/125 X |
| 2,508,959 | 5/1950 | Marino | 428/18 X |
| 3,204,433 | 9/1965 | Bureau | 431/125 X |
| 3,377,229 | 4/1968 | Bryan | 431/125 X |
| 3,817,686 | 6/1974 | Quittner | 431/125 |
| 3,993,430 | 11/1976 | Forker | 431/125 |

*Primary Examiner*—George F. Lesmes
*Assistant Examiner*—Henry F. Epstein
*Attorney, Agent, or Firm*—Orrin M. Haugen

[57] ABSTRACT

A noncombustible artificial log and method for simulating combustion thereof, wherein the artificial log is provided with fuel retaining recesses disposed at spaced axial locations therealong for receiving a readily combustible supply of fuel therein. The recesses are sufficiently deep so as to retain a supply of fuel therein which has a long burn duration. The recesses have a diameter which is small relative to the overall diameter of the artificial log.

4 Claims, 8 Drawing Figures

FIREPLACE SYSTEM

BACKGROUND OF THE INVENTION

The present invention relates generally to an improved apparatus and method for simulation of the burning of an artificial log. The artificial log is provided with fuel retaining recesses disposed at spaced axial locations, with the recesses being sufficiently deep so as to receive a supply of readily combustible fuel having a long burn duration.

In the past, fireplaces have traditionally been utilized in dwellings as a permanent installation. As such, the fireplaces are normally provided with a firebox, an ash clean-out zone therebeneath, and a stack which extends between the firebox and atmosphere, normally contained within a chimney. Traditional fireplaces are, of course, extremely expensive and, particularly in multistory dwellings, require unusual and extensive support columns. As building techniques and methods develop, it has been found extremely difficult to economically provide fireplace structures within tenant-occupied residences, particularly of the multiple story type.

SUMMARY OF THE INVENTION

In accordance with the present invention, an artificial fireplace structure may be utilized without requiring extremely heavy permanent installations, and wherein the simulated fire does not require venting to the atmosphere. The combustion is provided by a readily combustible material in sufficient quantities to have a burn duration of reasonable magnitude. The artificial log is provided with fuel retaining recesses for receiving the supply of fuel, and means may also be provided to vary the burn duration of the fuel within the individual recesses.

In order to preserve the integrity of the structure, the artificial log is preferably a hollow ceramic structure with the wall thickness being substantially equal throughout. This substantial uniformity of wall thickness enhances the durability of the structure, particularly when various portions of the structure are subjected to unequal ambient temperatures. In addition, for purposes of controlling the expansion and contraction, particularly during fabrication of the artificial log structures, a bore is formed on the base thereof so as to accommodate shrink, and thereby avoid fracture or rupture of the log wall.

Therefore, it is a primary object of the present invention to provide an improved noncumbustible artificial log structure capable of simulating a burning log, wherein the artificial log structure is provided with fuel retaining recesses at spaced axial locations therealong, and with the depth of the individual recesses being sufficient so as to permit the retention of a quantity of readily combustible fuel which has a burn duration of reasonable magnitude.

It is a further object of the present invention to provide an improved artificial log capable of simulating combustion thereof, wherein the artificial log is fabricated from a ceramic material arranged with substantially uniform wall thicknesses throughout so as to retain integrity of the structure upon exposure to varying differential temperatures.

It is yet a further object of the present invention to provide an improved noncombustible artificial log capable of simulation of combustion thereof, where in the artificial log is provided with a plurality of fuel retaining recesses at spaced locations therealong, and wherein the recesses may be provided with a load or fill of readily combustible fuel in a quantity sufficient to provide a burn duration of reasonable magnitude.

Other and further objects of the present invention will become apparent to those skilled in the art upon a study of the following specification, appended claims and accompanying drawing.

DESCRIPTION OF THE PREFERRED EMBODIMENT

In accordance with the preferred embodiment of the present invention, and with particular attention being directed to FIGS. 1–4 inclusive, it will be seen that the noncombustible artificial log generally designated 10 includes a ceramic structure or body 11 having a plurality of axially spaced fuel retaining recesses 12, 13 and 14 arranged therealong. As has been indicated, the individual fuel retaining recesses are arranged to receive and retain a supply of readily combustible fuel therewithin, with the supply being sufficient in quantity so as to provide a burn duration of reasonable magnitude. Specifically, a burn duration of up to about 2 hours is preferred.

Figure 1:
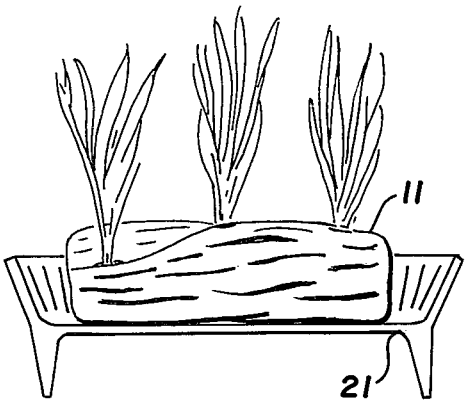
FIG. 1 is a front elevational view of a noncombustible artificial log prepared in accordance with the present invention, and illustrating the structure with combustible material being burned from fuel retaining recesses disposed therealong.
Figure 2:
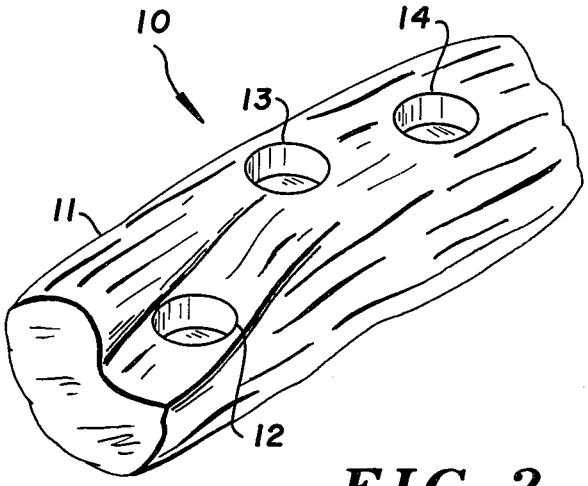
FIG. 2 is a top perspective view of the log illustrated in FIG. 1, and showing the arrangement of the individual fuel retaining recesses therealong.
Figure 3:
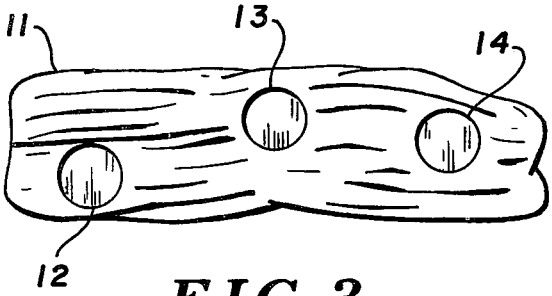
FIG. 3 is a top plan view of the log illustrated in FIG. 1.
Figure 4:
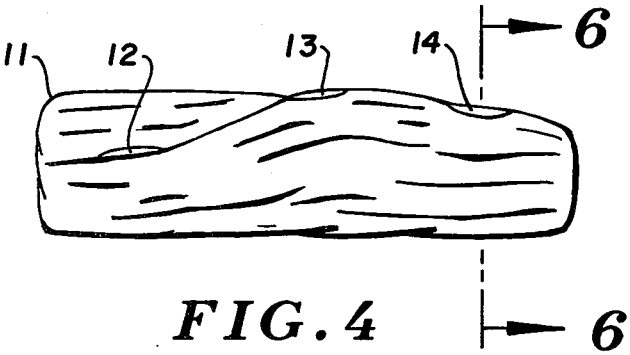
FIG. 4 is a front elevational view of the structure, and illustrating, in greater detail, the disposition of the individual fuel retaining recesses.
Figure 5:
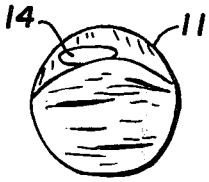
FIG. 5 is a side elevational view of the structure illustrated in FIGS. 1–4.
Figure 7:
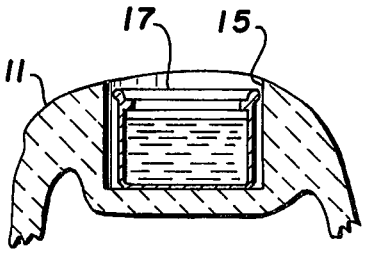
FIGS. 7 and 8 are fragmentary vertical sectional views on a slightly enlarged scale, and illustrating a fuel retaining receptacle being disposed within the fuel retaining recess, and with FIG. 7 illustrating the container in open disposition, and with FIG. 8 in covered disposition.
Figure 8:
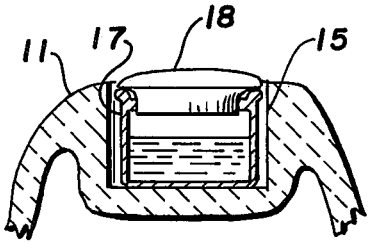

It will be observed from the view of FIGS. 2 and 4 that the fuel retaining recesses have a diameter which is small relative to the diameter of the artificial log per se, and further that the depth of the recesses is sufficient so as to accommodate an entire quantity of fuel therewithin, particularly in a pre-packaged fuel receptacle, such as is illustrated in FIGS. 7 and 8. Such pre-packaged receptacles are readily commercially available, and normally contain an alcohol product which is rendered substantially solid or semi-solid at room temperature. One such product is widely commercially available under the trade name "Sterno".

Figure 6:
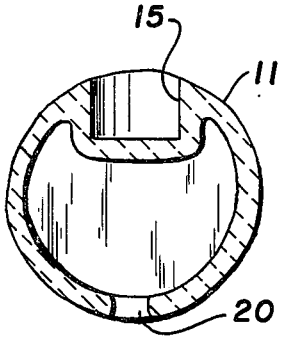
FIG. 6 is a vertical sectional view taken along the line and in the direction of the arrows 6—6 of FIG. 4 and illustrating the disposition of a fuel retaining recess therealong.

Attention is now directed to FIGS. 6, 7 and 8 wherein it will be noted that the wall thickness of the log structure is substantially uniform throughout thereby avoiding the location of "thin spots" throughout the log. Such "thin spots" or areas may, if present, contribute to a breaking or fracturing of the structure due to the wide differential temperatures to which the structure is exposed. Furthermore, the fuel retaining recesses are arranged so as to avoid the preparation of fracture prone zones, with rounded corners and the like being provided wherever feasible.

In the arrangement illustrated in FIGS. 7 and 8, a pre-packaged readily combustible fuel is shown as being retained within the walls 15 of the bore 14, with the pre-packaged supply of fuel being shown at 17. The container of fuel is illustrated at 17 and, as previously indicated, is of a type which is widely commercially available. In order to rapidly quench the fire, if desired, a cap member 18 may be slipped over the opening or top of fueled receptacle 17, as indicated in FIG. 8.

As has been indicated previously, an opening or bore is formed in the wall of the log as at 20 in order to accommodate shrinking of the ceramic structure for initial firing. Such a bore or opening is normally present in order to avoid the generation of fractures in the ceramic upon firing during production. The provision of such an opening in the structures of FIGS. 1–5 assist in preserving integrity of the artificial log during production and use.

As materials of construction, the noncombustible artificial log may be prepared from any durable ceramic such as conventional ceramic clays of the aluminum silicate variety. Typical clays include kaolinite, halloysite, montmorillonite and illite. Such clays are, of course, widely commercially available.

In the preparation of the noncombustible ceramic logs, any conventional technique may be employed for preparation. In a typical use situation, a plurality of logs, such as three logs for example, are arranged in a conventional fireplace grate 21 with noncombustible fiberglass such as is known as "angel hair" being disposed therebeneath. The angle hair is loaded with liquid combustible material, such as an alcohol with a relatively high flash point so as to render burning safe within a residential enclosure. Within the individual artificial logs, six individual containers of a pre-packaged combustible material such as "Sterno" are placed, with two having a relativly rapid rate of burn, and with the balance having a relatively slower rate of burn. Varying rates of burn are, of course, commercially available in this type of product. If desired, conventional candles or the like may be employed for providing a slow burn appearance of low intensity, and the rapidly burning pre-packaged containers may be replaced with candles upon burn out. Thereafter, of course, candles or other glowing burning substances may be employed as well.

What is claimed is:

1. A noncombustible artificial log comprising a substantially hollow tubular ceramic structure with an outer peripheral surface, fuel retaining recesses disposed at spaced axial locations along the upper solid portion of said outer peripheral surface for receiving a supply of readily combustible fuel therein at a recessed level below the normal artificial log peripheral surface, and with the fuel having a burn duration of reasonable magnitude, said recesses having a diameter which is small relative to the diameter of the hollow tubular artificial log structure and each of said recesses having a side wall and a bottom surface for retaining said fuel.

2. The noncombustible artificial log as defined in claim 1 being particularly characterized in that said artificial log is a hollow ceramic structure with a wall thickness thereof being substantially uniform throughout.

3. The noncombustible artificial log as defined in claim 1 being particularly characterized in that said noncombustible artificial log contains at least three spaced apart fuel receiving recesses.

4. In combination, a noncombustible artificial log with fuel receptacles formed therein, said artificial log comprising a hollow tubular ceramic structure having fuel retaining recesses disposed at spaced axial locations along the upper solid surface thereof for receiving a supply of readily combustible fuel therein at a recessed level below the normal artificial log surface, with the fuel being received in sufficient quantity so as to provide a burn duration of reasonable magnitude, said recesses having a diameter which is small relative to the diameter of the artificial log, each of said recesses having a side wall and a bottom surface and fuel containing receptacles being received within said recesses.

* * * * *